United States Patent [19]

Bachmann et al.

[11] Patent Number: 4,551,935

[45] **Date of Patent: * Nov. 12, 1985**

[54] DISPLAY PANEL FOR VENDING MACHINES

[75] Inventors: G. Merle Bachmann, Stone Mountain; Charles L. Davis; Annis R. Morgan, Jr., both of Atlanta, all of Ga.

[73] Assignee: The Coca-Cola Company, Atlanta, Ga.

[ * ] Notice: The portion of the term of this patent subsequent to Nov. 15, 2000 has been disclaimed.

[21] Appl. No.: 464,897

[22] Filed: Feb. 8, 1983

Related U.S. Application Data

[62] Division of Ser. No. 244,818, Mar. 17, 1981, Pat. No. 4,380,130.

[51] Int. Cl.[4] ..... G09F 7/00

[52] U.S. Cl. ..... 40/584

[58] Field of Search ..... 40/584, 1, 464; 194/1 A; D20/5

[56] References Cited

U.S. PATENT DOCUMENTS

| | | | |
|---|---|---|---|
| D. 179,919 | 11/1956 | Cormano | D20/5 |
| D. 209,919 | 1/1968 | Conde | D20/5 |
| 4,077,146 | 3/1978 | Nasgowitz | 40/464 |
| 4,245,730 | 1/1981 | Bachmann | 194/1 A |
| 4,367,604 | 1/1983 | Porter et al. | 40/464 |

*Primary Examiner*—Gene Mancene
*Assistant Examiner*—Wenceslao J. Contreras
*Attorney, Agent, or Firm*—Birch, Stewart, Kolasch & Birch

[57] ABSTRACT

A display panel is provided for the major obverse face of a vending machine in which contrasting panels provide the suggestion of a container of primary product in combination with a vending control array presenting that primary product in dominance of a plurality of secondary products to be vended so as to induce predominate selection of the primary product. The contrasting panels further provide a superimposed alphanumeric or other display configuration on the display panel to further enhance the dominant presence of the primary product.

8 Claims, 10 Drawing Figures

DISPLAY PANEL FOR VENDING MACHINES

This application is a divisional of copending application Ser. No. 244,818, filed on Mar. 17, 1981, now U.S. Pat. No. 4,380,130.

FIELD OF THE INVENTION

The present invention is related to display panels for vending machines and more particularly to improved configurations for same.

BACKGROUND OF THE INVENTION

In the vending of beverages from vending machines, particularly those beverages packaged in cans, bottles, or generally similar symmetrical containers, the display panels of the vending machines involved should perform certain point-of-purchase functions. For example, the nature of the products vended should be instantly apparent to a potential customer. The identity of the source or origin (manufacturer) of the products being vended should be either directly provided or provided by means such as logos or other symbolic means suggestive thereof.

Further, if there is a primary product for which the vending machine has more capacity or for which greater sales volume is desired, the vending machine should be capable of encouraging the selection of this product over the other products (secondary products) present in the machine.

It is an object of the present invention to provide a new and novel display panel configuration for vending machines.

Another object of the present invention is to provide a new and novel display panel for vending machines by combining the configuration and selective backlighting of panel sections on the obverse face of a vending machine to both directly and symbolically identify the manufacturer (source or origin) of the products being vended.

Still another object of the present invention is to provide a new and novel display panel for vending machines which suggests to a potential customer the packaged configuration of a product to be vended.

Yet another object of the present invention is to provide a new and novel display panel configuration for vending machines which, together with identifying products and the sources of such products, provides an inducement to a customer to purchase a particular primary one of a plurality of products made available by the vending machine bearing that display panel.

These and other objects of the present invention will become more fully apparent with reference to the following specification and drawings which relate to several preferred embodiments of the display panel structure of the invention.

SUMMARY OF THE INVENTION

The display panel configuration of the present invention comprises a generally rectangular field having one or more discharge ports in a transversely disposed first opaque field below the median height of the panel and a vertically disposed, generally rectangular second opaque field extending upward from one end of the first opaque field including a coin slot and a coin return actuator, bottle opener and coin return slots and a distinctive array of selector buttons. The array of selector buttons consists of two vertical parallel columns of selector buttons for secondary products topped by a single oversized primary selector button for a primary product which subtends the two vertical columns and is located adjacent the coin slot. All of the primary and secondary selector buttons identify the products corresponding thereto by appropriate logos, other marks of symbols.

The size and location of the primary selector button provides a dominant impression for the primary product identified thereon over the secondary products, thereby creating an inducement to purchase the primary product rather than the secondary products.

Mutually adjacent the first and second opaque fields is a first contrasting panel which is translucent and backlighted and which carries a logo, mark or symbol representative of the primary product. Further, the configuration of the first contrasting panel is such as to suggest the shape of the container for the primary product contained within the associated vending machine.

A second contrasting panel is positioned adjacent to and beneath the said first rectangular field and is transversely disposed across the display panel to complete the configuration thereof.

The second contrasting panel is configured such that, in conjunction with the first contrasting panel, there is provided a suggestion or abstract representation of the primary product logo, initial abbreviation or other identifying mark of symbol therefore such as an acronym.

The primary selector button being of several times the surface area of each of the secondary selector buttons provides space for a relatively large identifying symbol thereon for further emphasizing the primary product over the secondary products to potential purchasers. All of the selector buttons are illuminated such as by backlighting.

The arrangement of the secondary selector buttons in parallel vertical stacks beneath the primary selector buttons saves space on the display panel and permits maximizing the size of the selector buttons for better presentation of logos or other symbols.

The geometry of the first and second contrasting panels can be varied in the provision of configurations suggestive of containers and other symbols such as letters and the like.

Thus, the display panel configuration of the present invention is capable of superimposing subliminal suggestions of one symbol on another. For example, a logo can be presented with its arrangement on the first contrasting panel suggesting a can including the corresponding product while a further suggestion of an initial abbreviation or other alphanumeric character(s) is made by the combination of the configurations of the first and second contrasting panels.

DETAILED DESCRIPTION OF THE DRAWINGS

Figure 1:
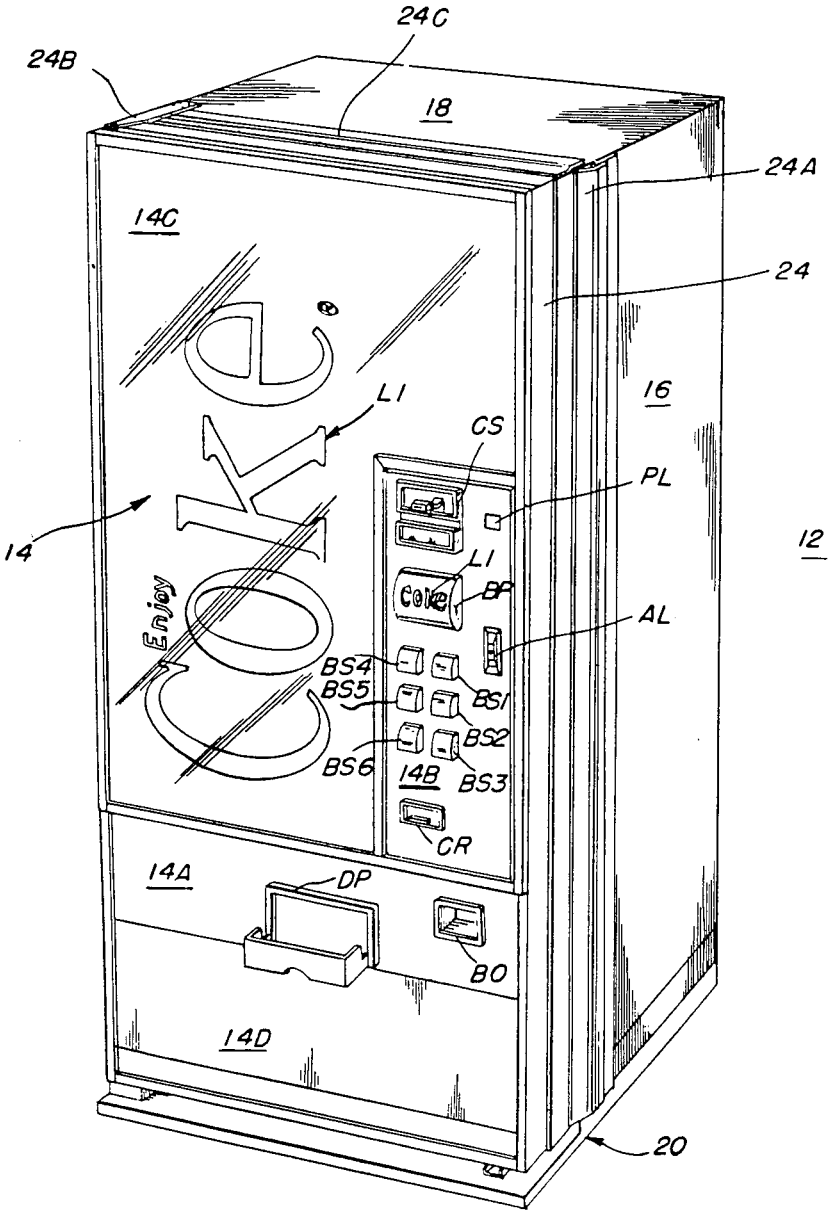
FIG. 1 is a perspective of a vending machine including a first preferred embodiment of a display panel of the present invention.
Figure 2:
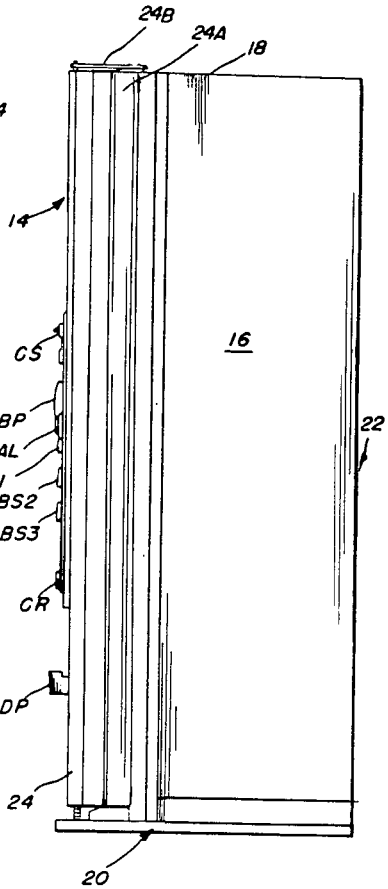
FIG. 2 is a side elevation of the vending machine and display panel configuration of FIG. 1.

Referring to FIGS. 1 and 2, a vending machine 12 incorporating the display panel 14 of the present invention is illustrated as being a basically three dimensional rectangular structure having vertical sides 16 joining horizontal top and bottom sides 18 and 20, respectively. The structure of the vending machine 12 is completed by a flat planar rear surface and a front panel comprising a door 24 which includes the display panel 14 as the obverse face thereof.

The door 24 includes a sealing skirt 24A along one vertical edge thereof and is provided with hinges 24B at the top and bottom of the door on the opposite vertical side thereof to permit access to the interior of the vending machine 12. The bottom surface 20 of the vending machine 12 is illustrated as a load bearing pad or the like which extends outwardly from the main body portion of the machine 12 beneath the door structure 24 and display panel 14.

A further overlapped sealing skirt structure 24C extends across the top of the door 24 and cooperates with the top surface 18 of the vending machine 12.

The display panel 14 of the present invention includes a first transversely disposed opaque field section 14A located below the median height of the panel 14 in the preferred embodiment illustrated, in which a discharge port DP and a bottle opener BO are positioned side by side.

A second opaque field 14B comprising the selection control portion of the display panel 14 is basically rectangular in shape in the embodiment illustrated and extends vertically from the upper right hand side of the transversely disposed first opaque field 14A. The vertical extent of the second opaque field (control panel) 14B is variable in the several preferred embodiments illustrated herein but in the preferred embodiments of FIGS. 1 and 2 extends from the upper edge of the transversely disposed first opaque field 14A to a point intermediate that edge and the uppermost edge of the display panel 14 of the present invention.

The remaining area above the uppermost edge of the first opaque field 14A and the top of the display panel 14 of the present invention is of an inverted L shape which is completely defined by a first contrasting panel 14C which is translucent and is back-lighted in a manner well known in the art, such as for example, the back-lighting arrangement illustrated in U.S. Pat. No. 4,245,730 of Bachmann et al, for "Display Panel for a Vending Machine" issued Jan. 20, 1981. The first contrasting panel 14C carries a logo L which is printed out for illustration and which in the embodiment shown serves to suggest; in combination with the manner of positioning the logo L thereon, a container shaped such as a can of the beverage "Coca-Cola," a Trademark of the Coca-Cola Company of Atlanta, Ga. The logo illustrated is for "Coke" which is also a well-known trademark of that company. Thus, the first contrasting panel with its logo serves to suggest to a potential purchaser utilizing the vending machine 12, a can of "Coke".

Beneath the lower edge of the first opaque field 14A is a transversely disposed second contrasting panel 14B which can be of various configurations or contrasting color zones, as desired, but which in the illustration of the preferred embodiment of FIGS. 1 and 2 constitutes a transversely disposed rectangular field which in combination with the shape (inverted L) of the first contrasting panel 14C provides a suggestion of the letter "C" which is an abbreviation for "COKE", the logo displayed on the first contrasting panel.

The presentation of goods within the vending machine 12 and the selection thereof for vending is accomplished by the second opaque field (control panel) 14B which includes the following components:

At the upper most edge of the control panel 14B is a coin-slot and return mechanism CS adjacent to which is a pricing label PL which displays a price for the various goods to be dispensed by the vending machine 12.

Beneath the coin slot mechanism CS is an enlarged primary product selector button BP which subtends two vertical columns of secondary product selector buttons BS1 through BS6, the secondary product selector buttons BS1–BS3 constituting one column and the secondary product selector buttons BS4–BS6 constituting a second vertical column parallel to the first.

All of the product selector buttons BP, BS1 . . . , BS6 carry various logos or symbols identifying the product corresponding thereto within the vending machine 12.

In the case of the primary selector button BP, the logo L1 thereon is identical to the logo L on the first contrasting panel 14C. This combination of the primary product logo L with its abstract suggestion of a can of the primary product beverage, in this specific example, together with the identical logo L1 on the primary product selector button BP provides a strong and effective inducement to a purchaser to purchase the primary product in the machine 12 in preference to all of the secondary products provided thereby.

This inducement to purchase is further enhanced by the combination of shapes presented by the first and second contrasting panels 14C and 14D, respectively, which superimpose an additional effect of a character which is an abbrevation for the primary product. This abbreviation for the primary product can also be an abbreviation for the manufacturer of the primary product depending upon the combined effect desired.

The control panel 14B (second opaque field) is completed by the provision of an access locking mechanism AL at the right hand edge thereof in a relatively medial position and a coin return slot CR at the lowermost edge portion thereof.

Preferably, the selector buttons BP, BS1 . . . BS6 all are provided with translucent indicia, and are back-lighted in a suitable manner known in the art to further emphasize and present the purchaseable contents of the vending machine 12 to a potential customer. The backlighting of the enlarged primary product selector button BP even further augments the presence of that primary product selector button and provides it with even more dominance over the subtended secondary product selector buttons BS1 . . . BS6 in the two vertical columns therebeneath.

Figure 3:
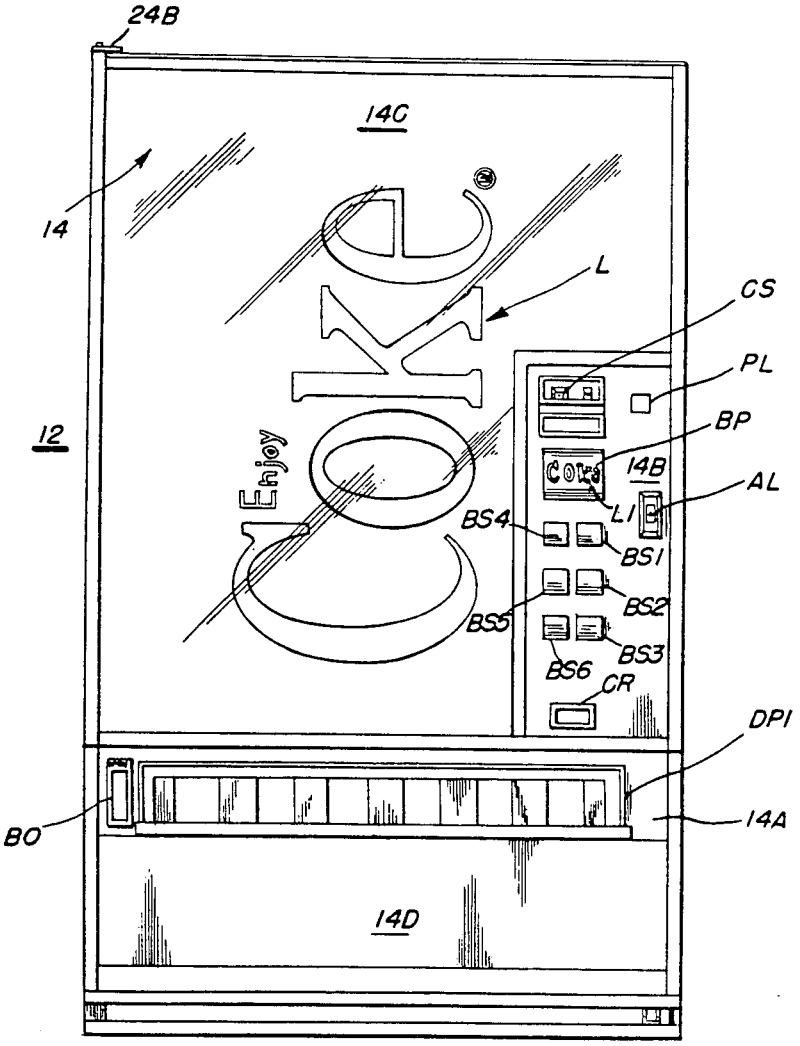
FIG. 3 is a front plan view of another display panel configuration of the present invention in which an alternate form of dispensing slot configuration is illustrated.

Referring to FIG. 3, a similar embodiment to that of FIG. 1 is illustrated with like numerals representing like portions and elements thereof. The primary difference between FIG. 3 and that of FIGS. 1 and 2 is in the provision of an elongated dispensing port DP1 shown in the first opaque field 14A and the shifting of the bottle opener BO to the far left hand side of the first opaque field 14A. Otherwise, the remaining configuration of the display panel 14 illustrated in FIG. 3 is identical to that illustrated in FIG. 1.

Figure 4:
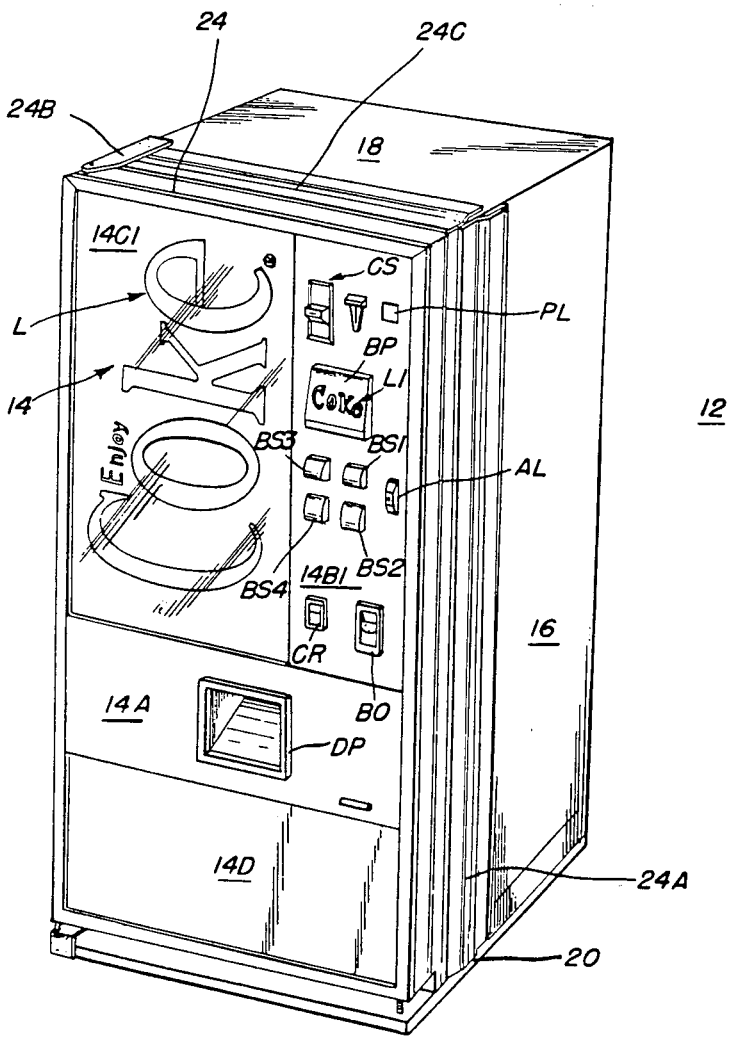
FIG. 4 is a perspective of yet another embodiment of the present invention in which the geometric configuration of the contrasting display panels has been modified to provide a different effect than that provided by the embodiments of FIGS. 1, 2 and 3.
Figure 5:
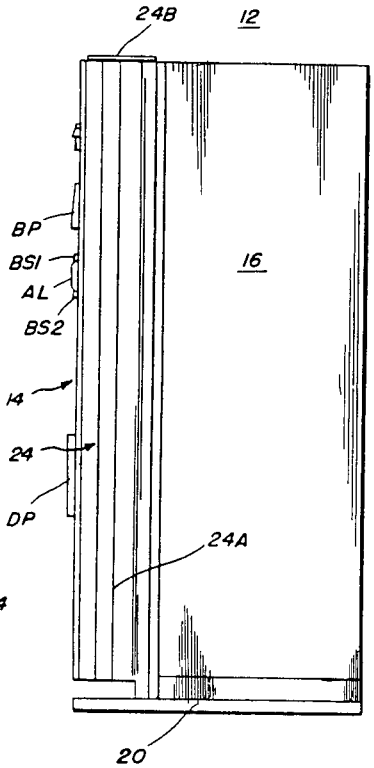
FIG. 5 is a side elevation of the embodiment of FIG. 4.

Referring to FIGS. 4 and 5, an alternate embodiment of the display panel 14 is illustrated as including modified configurations of the second opaque field (control panel) 14B1 which extends all the way from the upper edge of the first opaque field 14A to the top of the display panel 14. This renders the first contrasting field 14C1 rectangular in shape and therefore more directly symbolic of a "Can of Coke" or a container of beverage with a primary product logo of the users choice placed thereon.

The vending machine 12 illustrated in FIG. 4 is of a smaller capacity than those previously illustrated with respect to FIGS. 1, 2 and 3 and this reduced capacity is illustrated by the fact that there are only four secondary product selector buttons BS1 . . . BS4 present in two vertical columns of two selector buttons each, completely subtended, as in the other embodiments, by the uppermost primary product selector button BP which is much larger in size and extent than any of the said secondary product selector buttons. The relative dimensioning and positioning are for the various suggestive purposes previously described. It should be noted that various modifications of the configuration of the second contrasting panel 14D may be made in the event that the superimposed suggestion of an acronym or the like is desired by the combined effect of the various opaque and contrasting panels.

Figure 6:
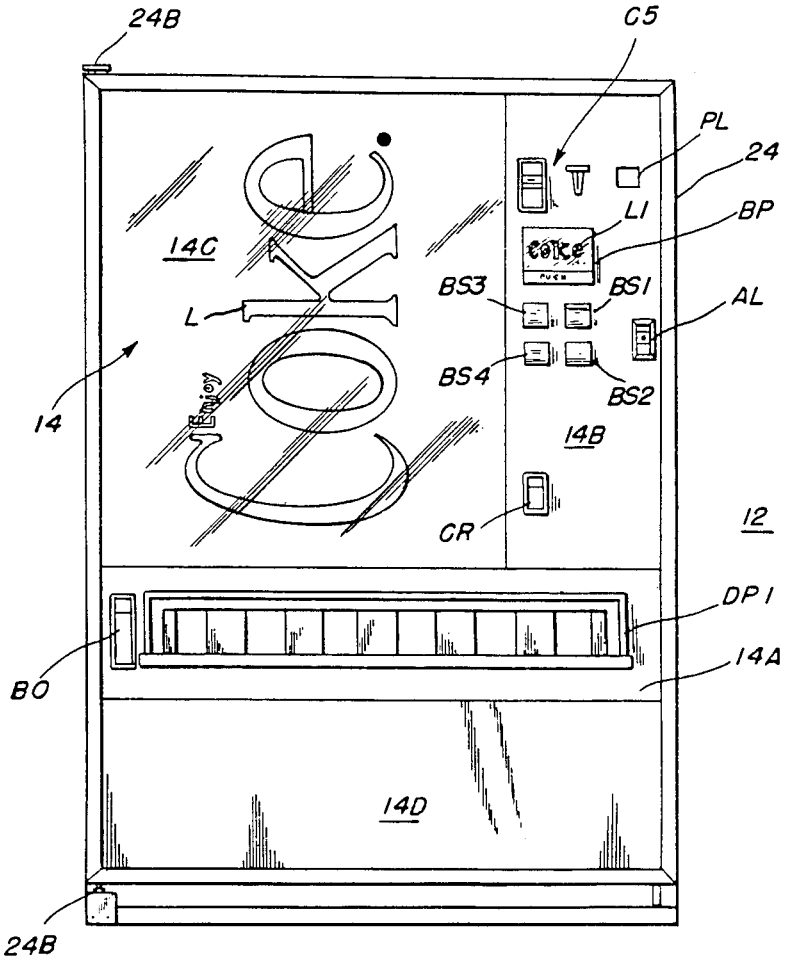
FIG. 6 is a front plan view of yet another display panel configuration of the present invention.

Referring to FIG. 6, the vending machine 12 illustrated therein is substantially identical to the machine 12 illustrated in FIGS. 4 and 5 with the exception of the relative vertical to width dimensions, the utilization of an elongated discharge port DT1 and an adjacent bottle opener BO in the transverse first opaque field 14A.

Figure 7:
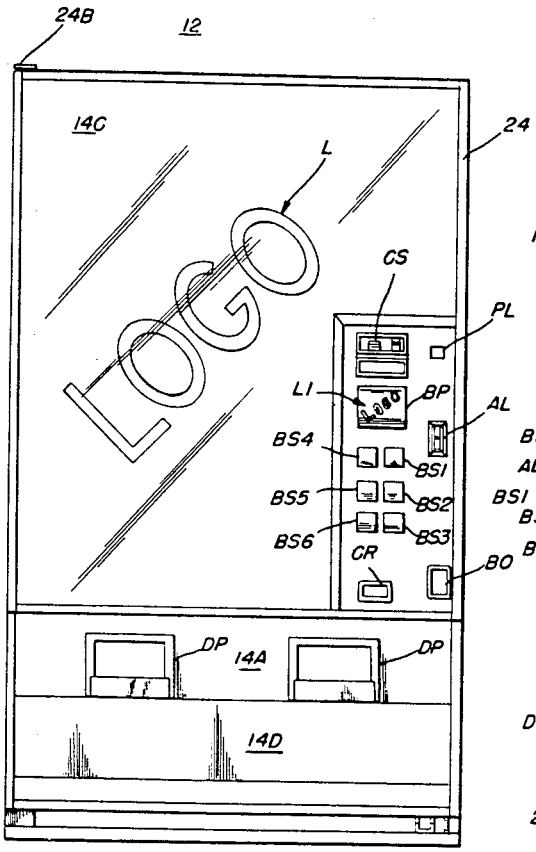
FIG. 7 is a front plan view of a display panel illustrating a diagonal orientation of a logo thereon.

The versatility of the vending machines 12 of the present invention with regard to configurations of the logo L is illustrated with reference to FIGS. 7, 8, 9, and 10. In FIG. 7, for example, the first contrasting panel 14C is of an inverted L shape and the logo L is placed thereon in a diagaonal fashion with respect to the primary rectangular portion of the first contrasting panel 14C, namely, that portion of the panel of the first contrasting panel 14C which is suggestive, albeit subliminally, of the shape of a can or container bearing the product identified by the logo L. On the primary product selector button BP, the logo L1 is disposed in the same orientation to completely identify with the primary product logo L of the first contrasting panel 14C. This selective orientation of the logo L1, made possible by the size of the primary product selector button BP, in combination with the location of the primary product selector button BP as previously described provides an enhanced dominant effect inducing selection of primary product over the secondary products presented by the subtended secondary product selector buttons BS1 . . . BS6.

Figure 8:
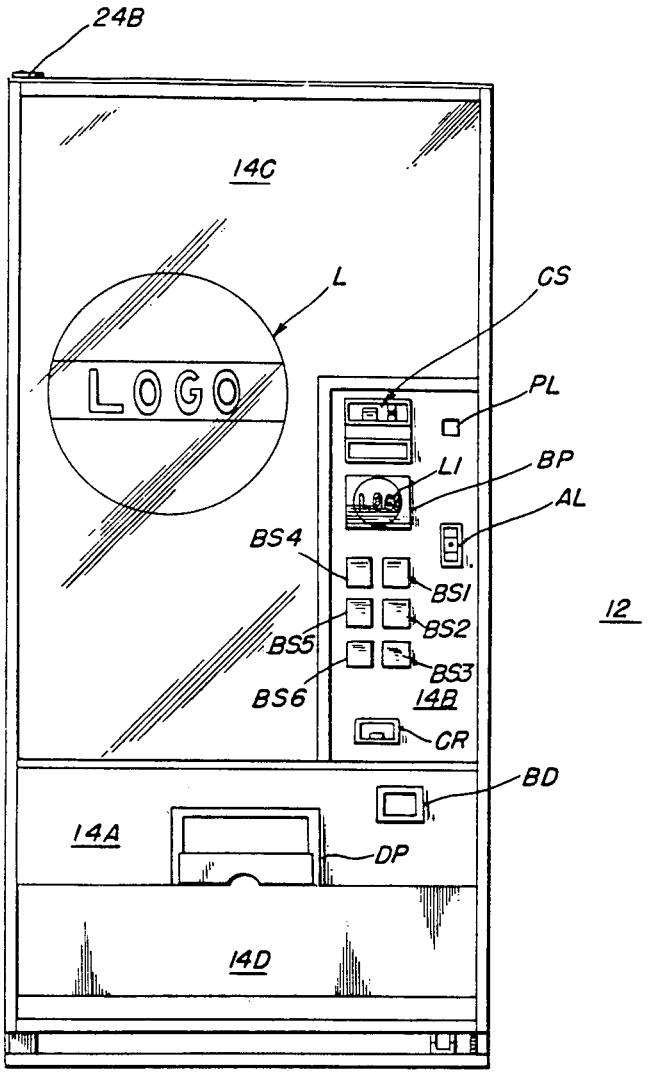
FIG. 8 is a front plan view of a display panel of the present invention illustrating a logo in a circular field placed thereon.

Referring next to FIG. 8, the logo L is shown as presented in a composite circular and substantially rectangular pattern with a duplicate logo L1 being placed on the primary selector button BP. Also, in FIG. 8, the bottle opener mechanism BO has been placed in the first opaque field 14A rather than in the second opaque field (control panel) 14B. Here, as in FIG. 7, the first contrasting panel 14C is in an inverted L shape and the second or transverse contrasting panel 14D is rectangular. The FIG. 7 embodiment also includes dual discharge ports DP in the first opaque field 14A.

Figure 9:
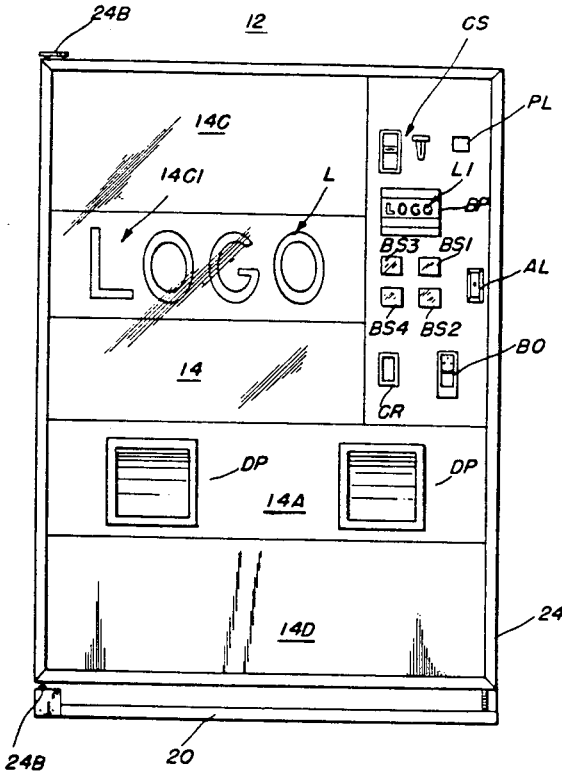
FIG. 9 is a front plan view of a display panel of the present invention illustrating a horizontally disposed logo thereon in a stripe shaped or rectangular field.
Figure 10:
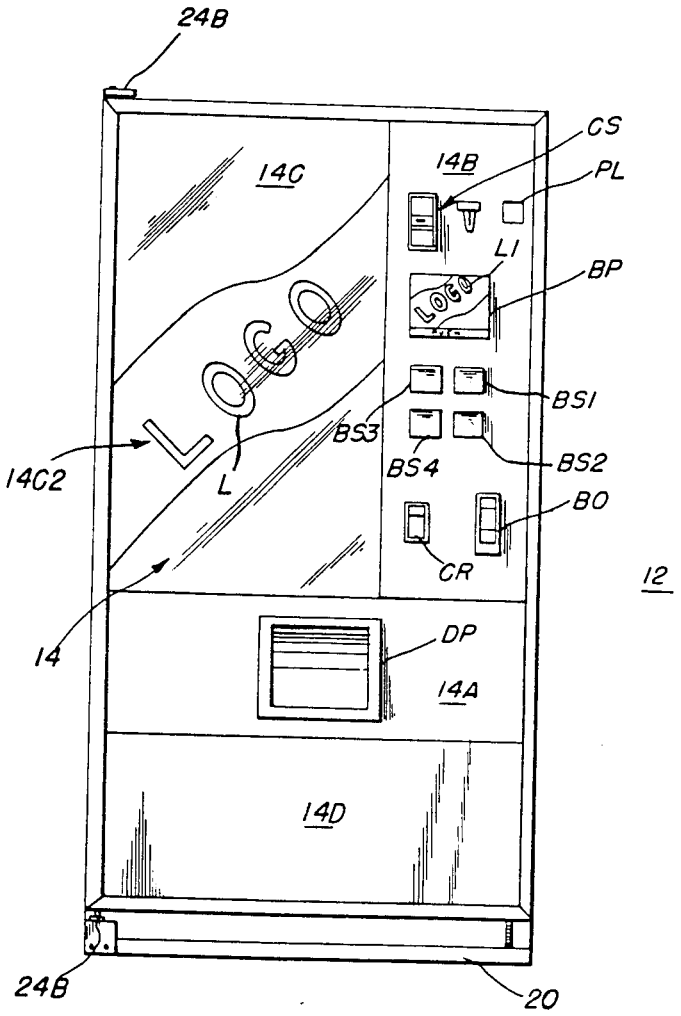
FIG. 10 is yet another front plan view of display panel of the present invention illustrating a diagonally disposed logo in a fanciful diagonally disposed contrasting color field.

Referring to FIGS. 9 and 10, the first contrasting panels 14C in each are of vertically elongated rectangular configuration forming the letter "L" with the second contrasting panels 14D which are still of rectangular transversely elongated configuration. The logo L in the embodiment of FIG. 9 is transversely disposed in the first contrasting panel 14C and is placed in a contrasting color zone 14C1 in the form of a transverse strip or rectangle. A similar logo (and contrasting field arrangement) L1 is illustrated on the primary product selector button BP. In the embodiment of FIG. 10 the logo in the first contrasting panel 14C is canted and is placed in a contrasting canted and fanciful color field 14C2, this arrangement being duplicated as a logo L1 on the primary product selector button BP.

Thus, as can be seen from FIGS. 9 and 10, the first contrasting panels 14C and the contrasting fields 14C1, 14C2 therein in conjunction with the logos presented in those contrasting color fields are more directly suggestive of a container than those suggestions presented in a more abstract form by the first contrasting panels 14C of the embodiments of FIGS. 7 and 8.

The letters "L" and "C" have been suggested, by the combined configurations of the upper and lower (first and second) contrasting panels 14C and 14D in the embodiments shown. In the event that other alphanumeric characters serving as abbreviations or otherwise for primary products or their sources are desired in a given display panel 14, then various contrasting color fields are contemplated such that the contrasting panels 14C and 14D can be further modified to suggest other shapes and symbols.

As can be seen from the foregoing specification and drawings the present invention provides a new and novel display panel having many suggestive features to induce potential customers to purchase a primary product presented by the machine, with which the display panels are associated, in preference to a selection of secondary products also presented thereby.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Display means for an obverse face of a vending machine comprising:

a plurality of panel means defining a like plurality of display fields within a defined display area;

selected ones of said panel means being of contrasting surface characteristics to the remaining said panel means in the provision of selected display configurations in said display area;

one of said selected panel means being a discharge panel means having discharge port means therein for presenting vended products, said discharge panel means extending horizontally across said obverse face of said vending means and dividing said obverse face into upper and lower sections;

another selected one of said panel means being disposed in said upper section and being configured with a substantially rectangular outline with the longest dimension of the rectangle extending vertically of said machine and including logo means so disposed thereon as to suggest the representation by said display panel means of the rectangular front elevational outline of an upright can of product with said logo means thereon; and control means in a remaining said panel means for controlling the vending of products from said vending machine, said control means including, secondary product selector button means in a vertical array for selecting secondary products to be vended, each having a secondary product display area thereon bearing indicia representative of a given secondary product to be vended, a primary product selector button means positioned above said vertical array so shaped and so proportioned as to present a primary product display area thereon larger than a said secondary product display area to provide a dominant pressure thereon in said control means, said primary product display area being substantially the same primary product logo as said another selected one of said panel means for inducing, in conjunction therewith, the predominant selection of said primary product over said secondary product by an observer of said display means.

2. The display means of claim 1, wherein said selected one of said panel means is backlighted to highlight said rectangular outline and logo means thereon.

3. Display means for an obverse face of a vending machine comprising:

a plurality of panel means defining a like plurality of display fields within a defined display area;

selected ones of said panel means being of contrasting surface characteristics to the remaining said panel means in the provision of selected display configurations in said display area;

one of said selected panel means being a discharge panel means having discharge port means therein for presenting vended products, said discharge panel means extending horizontally across said obverse face of said vending machine and dividing said obverse face into upper and lower sections;

another selected one of said panel means being disposed in said upper section and being configured with a substantially rectangular outline with the longest dimension of the rectangle extending vertically of said machine and including logo means so disposed thereon as to suggest the representation by said display panel means of the rectangular front elevational outline of an upright can of product with said logo means thereon; and control means in a remaining said panel means for controlling the vending of products from said vending machine, said control means including, a coin slot, first and second adjacent vertical columns of secondary product selector buttons, each having a secondary product display area thereon bearing indicia representative of a given secondary product to be vended, and a primary product selector button, which is larger than the respective secondary product selector buttons, positioned above said secondary product selector buttons adjacent said coin slot, said primary product selector button being so shaped and so proportioned as to overlie and extend across both said vertical columns of secondary product selector buttons and present a primary product display area thereon larger than a said secondary product display area to provide a dominant presence thereof in said control means, said primary product display area bearing substantially the same primary product logo as said another selected one of said panel means inducing, in conjunction therewith, the predominate selection of said primary product over said secondary products by an observer of said display means.

4. The display means of claim 3, wherein said selected one of said panel means is backlighted to highlight said rectangular outline and logo means thereon.

5. Display panel means for an obverse face of a vending machine comprising:

first panel means including discharge port means therein for vended products and defining a first display field transversely disposed on said display panel means;

second panel means including control means for selecting products to be vended and defining a second display field extending vertically from one end of said first display field;

third panel means having a substantially rectangular outline with the longest dimension of the rectangle extending vertically of said machine and defining a contrasting third display field above said first display field subtending an area on said display panel means defined by the other boundaries thereof and the said first and second display fields; and fourth panel means defining a contrasting fourth display field, subtending an area defined by the third display field and the outer boundaries of said display panel means;

said third panel means including logo means thereon representative of a primary product to be vended and said rectangular outline suggesting the appearance of the rectangular front elevational outline of an upright can of that product;

said control means for selecting products to be vended including, first and second adjacent vertical columns of secondary product selector buttons each having a secondary product display area thereon bearing indicia representative of a given secondary product to be vended, and a primary product selector button means positioned above and so shaped and so proportioned as to subtend both said vertical columns of secondary product selector buttons and present a primary product display area thereon larger than a said secondary product display area to provide a dominant presence thereof in said control means, said primary product display area bearing substantially the same primary product logo as said third panel means, for inducing in conjunction therewith, the predominate selection of said primary product over said secondary product by an observer of said display panel means.

6. The display means of claim 5, wherein said third panel means is backlighted to emphasize said rectangular outline and logo means thereon.

7. Display panel means for an obverse face of a vending machine, comprising:

first panel means including discharge port means therein for vended products and defining a first display field transversely disposed on said display panel means;

second panel means including control means for selecting products to be vended and defining a second display field extending vertically from one end of said first display field;

third panel means having a substantially rectangular outline with the longest dimension of the rectangle extending vertically of said machine and defining a contrasting third display field above said first display field subtending an area on said display panel means defined by the outer boundaries thereof and the said first and second display fields; and fourth panel means defining a contrasting fourth display field, subtending an area defined by the third display field and the outer boundaries of said display panel means;

said third panel means including logo means thereon representative of a primary product to be vended and said rectangular outline suggesting the appearance of the rectangular front elevational outline of an upright can of that product;

said control means for selecting products to be vended including, a coin slot, secondary product selector button means in a vertical array for selecting secondary products to be vended, each having a secondary product display area thereon bearing indicia representative of a given secondary product to be vended; and a primary product selector button, which is larger than the respective secondary product selector buttons, positioned above said secondary product selector button means adjacent said coin slot, said primary product selector button being so shaped and so proportioned as to present a primary product display area thereon larger than a said secondary product display area to provide a dominant presence theron in said control means;

said primary product display area bearing substantially the same primary product logo as said third panel means for inducing, in conjunction therewith, the predominate selection of said primary product over said secondary product by an observer of said display panel means.

8. The display means of claim 7, wherein said third panel means is backlighted to emphasize said rectangular outline and logo means thereon.

* * * * *